United States Patent [19]

Sova

[11] 3,963,208

[45] June 15, 1976

[54] SPRING-PRESSED-PLUNGER ARTICLE HOLDER

[76] Inventor: Clarence Sova, 2160 Union St., Windsor, Ontario, Canada

[22] Filed: Feb. 7, 1975

[21] Appl. No.: 547,792

[52] U.S. Cl. ..... 248/316 A; 24/263 PJ

[51] Int. Cl.[2] ..... A47H 1/10

[58] Field of Search ..... 24/263 SB, 263 PJ, 263 FC, 24/263 PC; 211/89, 120; 248/229, 311, 313, 316 R, 316 A, 316 C

[56] References Cited

UNITED STATES PATENTS

| | | | |
|---|---|---|---|
| 2,459,006 | 1/1949 | Sova | 211/89 |
| 2,973,099 | 2/1961 | Sova | 211/89 |
| 3,039,728 | 6/1962 | Sova | 248/316 A |
| 3,653,096 | 4/1972 | Fernberg | 248/74 PB X |

*Primary Examiner*—Roy D. Frazier
*Assistant Examiner*—Lawrence J. Staab
*Attorney, Agent, or Firm*—Willis Bugbee

[57] ABSTRACT

A hollow horizontal support of inverted U-shaped cross-section has a base plate secured transversely thereto at its rearward end, and also has parallel side walls interconnected by a top wall, and further has a forward end wall with a downwardly-extending portion serving as a fixed article-gripping jaw. Slidably mounted in a hole in this end wall and provided with a movable article-gripping jaw projecting downward therefrom is a spring-pressed plunger, the forward end of which projects forwardly through the forward end wall in a push-button portion, the rearward end of which slidably engages the side wall of a hole in the front wall of a hollow rear spring abutment and plunger guide member of up-ended scoop-shaped form disposed in the interior of the U-shaped support and held therein by integral transverse lugs projecting laterally therefrom and fitting into notches in step portions of the opposite side walls of the support. A compression coil spring encircling the reduced-diameter rearward portion of the plunger between the movable article-gripping jaw and the fixed spring abutment member urges the movable article-gripping jaw into gripping engagement with an article inserted between it and the fixed article-gripping jaw.

1 Claim, 9 Drawing Figures

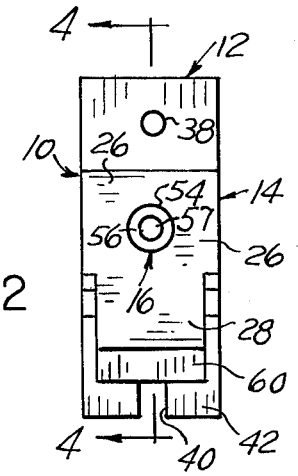
FIG. 2
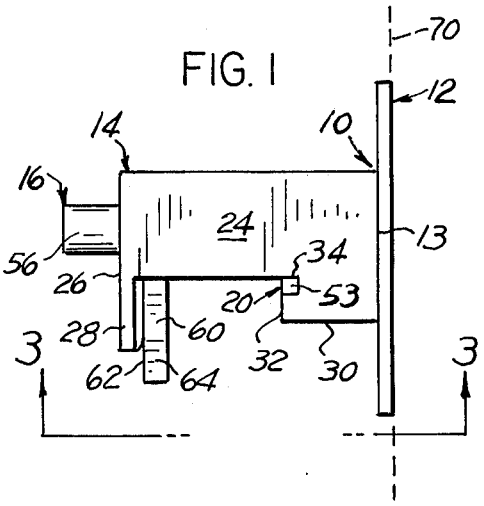
FIG. 1
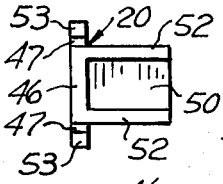
FIG. 7
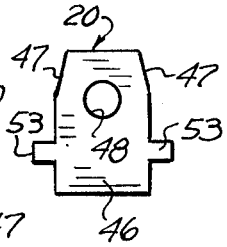
FIG. 6
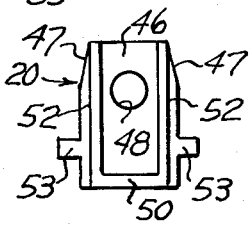
FIG. 8
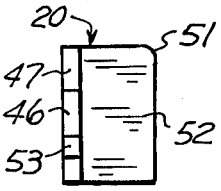
FIG. 9
FIG. 3
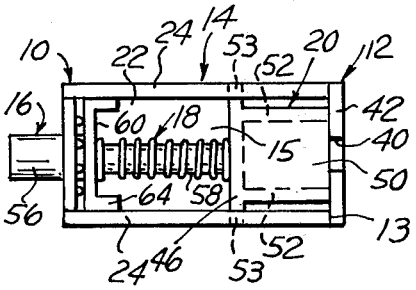
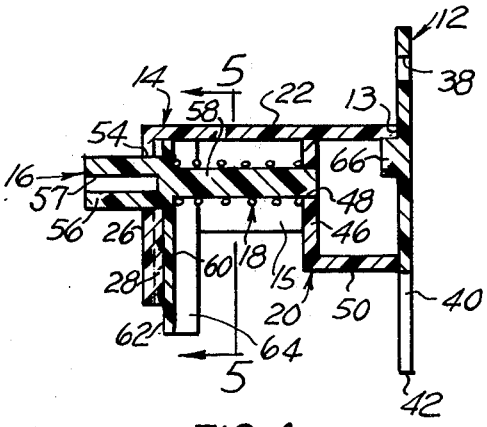
FIG. 4
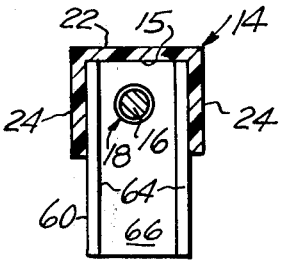
FIG. 5

SPRING-PRESSED-PLUNGER ARTICLE HOLDER

SUMMARY OF THE INVENTION

This invention is characterized by the simplified construction of this article holder with a minimum number of parts, particularly by the base plate secured to the rearward end of the hollow support of U-shaped cross-section containing the elongated open-bottomed cavity receiving the up-ended scoop-shaped rear spring abutment and plunger guide member held therein in direct engagement with the base plate by laterally-projecting lugs fitting into notches in step portions on the opposite side walls of the post; also by the parallel side walls of the box-shaped fixed spring abutment member held in close proximity to the base plate and the walls of the supporting post by said lugs fitting into said notches.

In the drawing,

FIG. 1 is a side elevation of a spring-pressed-plunger article holder, according to one form of the invention, as mounted on and projecting horizontally from a vertical building or mounting wall;

FIG. 2 is a front elevation of the article holder shown in FIG. 1;

FIG. 3 is a bottom plan view of the article holder, looking upward in the direction of the arrows 3—3 in FIG. 1;

FIG. 4 is a central vertical longitudinal section, taken along the line 4—4 in FIG. 2;

FIG. 5 is a vertical cross-section, taken along the line 5—5 in FIG. 4; and

FIGS. 6, 7, 8 and 9 are respectively a front elevation, top plan view, rear elevation and side elevation of the up-ended scoop-shaped rear spring abutment and plunger guide member used in the article holder shown in FIGS. 1 to 5 inclusive.

Referring to the drawing in detail, FIG. 1 shows a spring-pressed-plunger article holder, generally designated 10, according to one form of the invention, as composed of parts most of which are molded from synthetic plastic material. The article holder 10 consists generally of a base plate 12, which is secured to the rearward end 13 of a forwardly projecting hollow support 14 of invented U-shaped cross-section (FIG. 5) containing an elongated open-bottomed cavity 15 in which a reciprocable clamping plunger 16 is urged in a clamping direction by a compression coil spring 18 having its forward end abuttingly engaging the plunger 16 (FIG. 3) and its rearward end abuttingly engaging an up-ended scoop-shaped rear spring abutment and plunger guide member 20 fitted into the cavity 15 in the hollow support 14.

The hollow support 14 has an upper wall 22 (FIG. 4) from which spaced parallel side walls 24 (FIG. 3) project downward. The side walls 24 are molded integral with the top wall 22 and with a forward end wall 26 (FIG. 4) which is perpendicular to the top wall 22 and side walls 24 and extends downward beyond the side walls 24 in a fixed widened gripping jaw portion 28. At their lower edges the side walls 24 are provided with integral forwardly-facing step portions 30 (FIG. 1), the forward edges 32 of which are provided with rearwardly extending notches 34. The base plate 12 is provided with a fastener hole 38 and a mounting slot 40 extending upward from its lower end 42 (FIGS. 2, 3 and 4).

Seated within the hollow support 14 is the rear spring abutment and plunger guide member 20, which has a forward spring abutment wall 46 with an upwardly-tapered upper end portion 47 and with a rearward plunger guide hole 48 (FIG. 4), a lower wall 50 and parallel opposite side walls 52 with rounded corners 51 (FIGS. 3, 4 and 6 to 9 inclusive). The forward wall 46 has integral lugs 53 projecting laterally therefrom into the notches 34. The forward end wall 26 of the supporting post 14 is provided with a forward plunger guide hole 54 (FIG. 4), the side walls of which slidably engage an enlarged diameter forward push-button portion 56 containing a bore 57 for optionally receiving the stem of an enlarged head (not shown). Integral with the plunger 16 between its portion 56 and its shank 58 is a movable article-gripping jaw 60 with a downwardly-extending widened article-gripping portion 62 which cooperates with the downwardly-extending widened lower end portion 28 of the front wall 26 to grip an article therebetween. The movable jaw 60 has spaced parallel rearwardly-projecting reinforcing ribs 64 integral therewith (FIGS. 3 and 5).

The rearward end of the reduced diameter portion 58 of the plunger 16 is guided by and slidably engages the side walls of the rearward plunger guide hole 48 (FIG. 4) in the forward wall 46 of the fixed spring abutment member 20. Projecting forward into the interior of the rearward spring abutment 20 from the base plate 12 is a stop portion 66 which serves as a rearward stop for limiting the reciprocation of the plunger 16. The hole 38 in the upper portion of the base plate 12 (FIG. 2) cooperates with the slot 40 (FIGS. 2 and 4) for the reception of mounting fasteners (not shown) by which the article holder 10 may be secured to a wall 70 (FIG. 1). The wall 70 may consist of the wall of the room or, in the alternative, may constitute a mounting plate supporting a plurality of article holders 10 disposed in spaced parallel relationship for holding a plurality of articles. Such a multiple holder arrangement is disclosed and claimed in my prior U.S. Pat. No. 2,973,099 issued Feb. 28, 1961 for Multiple Article Holder.

In the manufacture of the spring-pressed-plunger article holder 10, the hollow support 14 is molded from suitable plastic material as one unit, together with its front wall 26 and widened gripping jaw portion 28. The plunger 16 is also molded as a single unit from suitable plastic material with the movable gripping jaw 60 and its widened portion 62 and ribs 64 integral with one another. These in turn are molded integral with the reduced diameter rearward portion or shank 58 in the same operation. The rear spring abutment and plunger guide member 20 of up-ended scoop-shaped form likewise is molded in a single operation with its lugs 53, forward wall 46, side walls 52 and lower wall 50 integral with one another.

In the assembly of the spring-pressed-plunger article holder 10, the base plate 12, together with the plunger abutment block 66 adhering thereto, is first secured by a suitable adhesive, such as epoxy resin, to the rearward end 36 of the support 14. The helical compression spring 18 is then placed around the reduced diameter portion or shank 58 of the plunger 16, and the up-ended scoop-shaped rear spring abutment and plunger guide member 20 placed against its rearward end with its plunger guide hole 48 slid onto the reduced diameter portion 58 of the plunger 16 and pushed toward the enlarged push button portion 56 so as to compress and hence shorten the spring 18 against the movable gripping jaw 60. With this assembly held between the thumb and forefinger or in suitable clamping pliers or tongs, the enlarged forward push button portion 56 is slid through the guide hole 54 in the forward wall 26 of the supporting post 14 with the rear spring abutment member 20 tilted downward relatively to the shank 56 of the plunger 16, this tilting being permitted by forming the hole 48 in the rear spring abutment member 20 of sufficiently larger diameter than the plunger shank 58 to provide a clearance therebetween sufficient to permit such tilting. With the parts so positioned, the fixed spring abutment and plunger guide member 20 is then pushed upward along the forward edges 32 of the step portion 30, into the open-bottomed cavity 15 within the hollow support 15 guided by the tapered upper end portions 47 of its forward wall 46, until the lugs 52 become aligned with and snap into the rearwardly-extending notches 34 (FIG. 1). The spring abutment 20 is then rocked relatively to the shank 58 of the plunger 62 into a position coaxial with the plunger 16, assisted by the rocking and sliding engagement of the rounded corners 51 against the base plate 12.

I claim:

1. A spring-pressed-plunger article holder adapted to be mounted upon an upright wall, said article holder comprising an elongated hollow open-bottomed support having a top wall and laterally-spaced side walls and a forward end wall, an article-holder-mounting base plate secured to the rearward end of said support, said walls and said base plate cooperatively defining an elongated open-bottomed plunger-housing cavity in said support, said forward end wall having a forward plunger guide hole therethrough and having a fixed article-gripping jaw extending downward therefrom, a combined rearward spring abutment and plunger guide member disposed in said cavity in direct engagement with said base plate, said combined abutment and guide member having a rearward plunger guide hole therethrough coaxial with said forward guide hole, means for securing said rearward spring abutment and plunger guide member within said support cavity with its rearward plunger guide hole in alignment with said forward plunger guide hole, an elongated plunger slidably mounted in said guide holes and having a push-button portion projecting forwardly from said forward end wall, said plunger also having a movable article-gripping jaw depending transversely therefrom in parallel relationship to said fixed article-gripping jaw and movable unitarily with said plunger, and a spring member disposed between said movable jaw and said spring abutment and plunger guide member and adapted to urge said movable article-gripping jaw toward said fixed article-gripping jaw into gripping engagement with an article disposed therebetween, said combined rearward spring abutment and plunger guide member being of up-ended scoop shaped construction with a front wall, a pair of side walls disposed in spaced parallel relationship, and a bottom wall interconnecting the lower ends of said front wall and side walls, said plunger being loosely mounted in said rearward guide hole whereby to greatly facilitate tilting and sliding of said abutment and guide member relatively to said plunger during assembly, said side walls of said abutment and guide member having rounded upper rearward corners adapted to rockably and slidably engage said base plate during tiltable insertion of said member into said cavity.

* * * * *